US008106598B1

(12) United States Patent
Yates

(10) Patent No.: US 8,106,598 B1
(45) Date of Patent: Jan. 31, 2012

(54) METHOD AND APPARATUS FOR ASSURING COMPLIANCE WITH HIGH EFFICIENCY LIGHTING STANDARDS

(76) Inventor: James P. Yates, Charleston, IL (US)

( * ) Notice: Subject to any disclaimer, the term of this patent is extended or adjusted under 35 U.S.C. 154(b) by 409 days.

(21) Appl. No.: 12/383,559

(22) Filed: Mar. 24, 2009

Related U.S. Application Data

(60) Provisional application No. 61/070,442, filed on Mar. 24, 2008.

(51) Int. Cl.
*H05B 37/00* (2006.01)

(52) U.S. Cl. ..... 315/291; 315/106; 315/107

(58) Field of Classification Search ..... 315/291, 315/94, 101, 102, 104, 105, 106, 107, 112, 315/118, 76, 363; 362/227, 228, 260, 234, 362/236, 276
See application file for complete search history.

(56) References Cited

U.S. PATENT DOCUMENTS 5,595,438 A * 1/1997 Burd ..... 362/228
6,300,725 B1 * 10/2001 Zinkler et al. ..... 315/291

* cited by examiner

*Primary Examiner* — David Hung Vu
(74) *Attorney, Agent, or Firm* — Kenneth E. Darnell

(57) ABSTRACT

Method and apparatus for assuring use of a fluorescent or similar high efficiency lamp in a screw base socket, the invention provides a circuit containing a screw base socket and an associated thermal sensing unit capable of interrupting power to the circuit on sensing of heat such as is generated by an incandescent or similar low efficiency lamp when mounted in the screw base socket. Practice of the method permits use of only fluorescent or similar lamping such as is incapable of sufficient heat generation to interrupt power to the circuit, the methodology of the invention preventing use of incandescent or similar energy inefficient lamping. The method and apparatus are particularly useful in the lamping of recessed downlighting fixtures.

10 Claims, 3 Drawing Sheets

METHOD AND APPARATUS FOR ASSURING COMPLIANCE WITH HIGH EFFICIENCY LIGHTING STANDARDS

CROSS-REFERENCE TO RELATED APPLICATIONS

This application is a Nonprovisional application of Provisional application Ser. No. 61/070,442, filed Mar. 24, 2008, upon which priority is claimed.

BACKGROUND OF THE INVENTION

1. Field of the Invention

The invention relates generally to energy efficient lighting circuitry and other circuitry and particularly to method and apparatus for preventing the use of energy inefficient lamping such as incandescent lamping having a standard screw base while permitting use of energy efficient lamping such as fluorescent lamping having a standard screw base in circuits having a standard screw base socket.

2. Background of the Invention

Governmental regulations such as Title 24 in force in the state of California require use of high efficiency lamping such as fluorescent lamping in residential and other lighting applications. In order to prohibit use of energy wasteful lamping such as incandescent lamping and the like, these regulations require use of lamp sockets that can only receive lamping having pin, prong or similar base structures characteristic of certain lamping including relatively specialized fluorescent lamping. Mandates of this nature place an extraordinary burden on lighting consumers due to the expense, general unavailability and confusing variety of lamping having pin or similar base structures. Further, at least some lamping of this nature is configured with expensive and unusual ballasts requiring an electrician for change out. Accordingly, regulations prohibiting use of incandescent and similar energy wasteful lamping such as are typically configured with standard screw bases are enforced by prohibiting use of screw base sockets, thereby leading to the difficulties noted. Such prohibitions prevent use of relatively inexpensive and readily available compact fluorescent and similar lamping commonly available with standard screw bases and therefore useable in screw base sockets. From a practical standpoint, the use of standard screw base sockets is desirable and would be preferred in the event methodology and apparatus were to be provided that would assure the use of high efficiency lamping in screw base sockets by preventing the use in screw base sockets of low efficiency, energy wasteful lamping such as incandescent lamping. This need exists in all lighting applications and particularly in recessed downlighting applications which comprise a substantial portion of both residential and commercial uses and which has not previously been particularly adapted to energy efficiencies.

The prior art has provided lighting circuitry typically provided with standard screw base sockets and which included thermal protection devices capable of detecting undesirable heat levels in lighting fixtures and particularly recessed downlighting fixtures. On detection of undesirable, typically dangerous, heat levels by such thermal protection devices used in circuits disclosed in U.S. Pat. No. 4,314,223 to Kristofek; U.S. Pat. No. 4,388,677 to Druffel and U.S. Pat. No. 4,685,037 to Akiyama inter alia, power to such lighting circuits is interrupted at least until heat dissipation reduces heat levels to values within an acceptable range. Screw base sockets per se capable of interruption of power to lamping on detection of dangerous heat levels have also been provided by Dombrowski et al in U.S. Pat. No. 4,131,868. Tibolla in U.S. Pat. No. 4,396,898 and Parissi et al in U.S. Pat. No. 2,458,724 inter alia. Wright et al, in U.S. Pat. Nos. 5,836,678 and 6,089,732, disclose the use of thermal protection devices in recessed downlighting fixtures which function to permit use of an identical lamp housing can for both insulation contact (IC) and non-insulation contact (non-IC) installations. While thermal protective circuits have long been used to interrupt power to lamping, this power interruption has been intended to prevent heat levels from reaching dangerous levels. Prior art circuitry has not been used in the practice of methodology for assuring compliance with energy regulations by permitting the use of only high efficiency lamping such as fluorescent lamping in standard Edison-mount or screw base sockets. Practice of the present methodology envisions and provides for the first time the ability to assure compliance with energy efficiency regulations without the need to proscribe use of screw base sockets. Practice of the invention further permits use under energy efficiency regulations of relatively inexpensive and readily available compact fluorescent lamping and similar lamping typically provided with standard screw bases in circuits having standard screw base sockets.

The invention contemplates methodology and apparatus capable of assuring compliance with energy efficiency regulations requiring use of highly energy efficient lamping such as fluorescent lamping while preventing use of energy wasteful, low efficiency lamping such as incandescent lamping and the like while retaining the ability to use standard screw base sockets in lighting circuits, the invention further providing advantages through reduction of a user's ability to circumvent operation of circuitry so used and through the ability to use fluorescent lamping such as compact fluorescent lamping and other lamping which is commonly provided with standard screw base systems. The invention therefore provides substantial advances in the art not previously provided.

SUMMARY OF THE INVENTION

The invention provides method and apparatus in preferred embodiments for preventing the use of energy inefficient electrical devices such as incandescent lamping and the like having standard screw base structure or the like in circuits including standard screw base sockets or the like while permitting use of energy efficient electrical devices such as fluorescent or similar lamping having standard screw base structures or structure capable of being fitted into compatible base structures, the invention thus assuring compliance with energy codes such as Title 24 regulations as have been adopted in California. The invention provides apparatus having thermal sensing capability configured either as an integral portion of a standard screw base socket or the like or as a separate circuit element disposed in proximity to a standard screw base socket or the like, apparatus configured according to the invention and methodology employed in practice of the invention being useful in lighting and other applications of widely varying kind. As examples in the lighting field, the invention can be employed in recessed or surface-mount downlighting wherein a lamp is housed within a lamp housing or can and even in applications as simple as a bare socket mounted to a ceiling, wall or other structure including post-mounted luminaires and the like whether or not enclosed.

In a particularly preferred embodiment, practice of the methods of the invention assures compliance with energy efficiency regulations requiring the use of lamping such as fluorescent lamping rather than energy inefficient incandescent lamping without requiring fluorescent lamping having pin, prong or similar bases that are expensive and difficult to locate, practice of the invention permitting use of fluorescent lamping such as readily available and relatively inexpensive compact fluorescent lamping having standard screw base structures mateable with standard screw base sockets while prohibiting the use of inefficient incandescent lamping in such screw base sockets.

A circuit configured for practice of the invention includes a screw base socket and a thermal sensing device placed in the circuit and located to sense a given heat level in the vicinity of the socket so as to interrupt power to the socket on attainment of said given heat level and to thereby prevent practical use of incandescent or similar lamping that unavoidably generate sufficient heat to produce said given heat level. According to one embodiment of the invention, a screw base socket or the like is configured with an integral thermal sensing device capable of detecting a given heat level either within or in proximity to the socket so as to interrupt power to the socket and/or circuit.

A particular use environment of the invention is a lighting application generally referred to as recessed downlighting, fixtures used in this environment typically employing a lamp housing or can mounted by a support or pan and typically held between ceiling joists or mounted to a suspended ceiling. In this use environment, a standard Edison-mount or screw base socket is typically mounted interiorly of the can to receive a lamp having a standard screw base. Disposition of a thermal sensing device, also known as a thermal protector or the like, on interior or exterior portions of the can or otherwise located in proximity to the lamping or the socket permits functioning of the thermal sensing device to interrupt power to the circuit containing the socket to extinguish the lamping. Such circuitry configured to interrupt power at heat levels experienced with incandescent or similar lamping but not with fluorescent or similar lamping assures compliance with energy efficiency regulations without the need for prohibiting the use of screw base sockets and with the further advantage of permitting the use of fluorescent and other lamping such as commonly available compact fluorescent lamping and the like.

Circuits of the invention for permitting employment of the methodology of the invention are configured to prevent disablement of the thermal sensing capabilities of the circuits. As a practical matter, the invention prevents retrofitting of incandescent lamping for fluorescent lamping after final inspection of new construction.

Accordingly, it is an object of the invention to provide methods and apparatus for permitting the use of energy efficient electrical loads in circuits rather than energy inefficient electrical loads that inherently generate wasteful heat within circuits having electrical sockets capable of receiving base structures employed on both the efficient and inefficient electrical loads.

It is another object of the invention to provide methods and apparatus for permitting the use of energy efficient lamping such as fluorescent lamping and the like in lighting circuitry having at least one standard screw base socket and preventing the use of energy inefficient lamping such as incandescent lamping and the like, and wherein both the efficient and inefficient lamping are configured with standard screw base structures, the circuitry also including at least one thermal sensing device capable of interrupting power to the circuitry on attainment of heat levels such as are capable of being generated by the energy inefficient lamping and not by the energy inefficient lamping, thus assuring compliance with energy efficiency regulations or assuring energy efficient practices.

It is a further object of the invention to provide downlighting including recessed downlighting having a lamp housing mounting a socket capable of receiving a lamp base employed by both energy efficient lamping such as fluorescent lamping or the like and energy inefficient lamping such as incandescent lamping or the like, a circuit connecting the socket also having a thermal sensing capability whereby power to the circuit can be interrupted on attainment of predetermined heat levels within the lamp housing as are produced by operation of the energy inefficient lamping but not by the energy efficient lamping, the thermal sensing capability being provided by thermal sensing devices disposed either on interior or exterior portions of the lamp housing or in proximity to the socket or lamping.

It is yet another object of the invention to provide lighting circuitry having a socket such as a standard screw base socket wherein a thermal sensing capability is provided on or in the socket, the socket being capable of mounting for operation energy efficient lamping such as fluorescent lamping or the like having a screw base structure capable of receipt in the socket and being incapable of mounting for operation energy inefficient lamping such as incandescent lamping or the like due to the sensing of heat produced by said energy inefficient lamping to thereby interrupt power to the circuit, use of the energy efficient lamping being permitted due to the relatively low levels of heat generated by the energy efficient lamping.

Further objects and advantages of the invention will become more readily apparent in light of the following detailed description of the preferred embodiments of the invention.

DESCRIPTION OF THE PREFERRED EMBODIMENTS

The disclosures of U.S. Pat. Nos. 2,458,724; 4,131,868; 4,314,223; 4,388,677; 4,396,898; 4,685,057; 5,177,658; 5,836,678 and 6,089,732 are incorporated hereinto by reference.

Reference herein to incandescent lamping or to similar or other energy inefficient lamping refers to lamping wasteful of energy and which energy is converted to heat of a magnitude capable of causing that function detailed herein. Further, reference herein to fluorescent lamping or to similar or other energy efficient lamping refers to lamping not only inclusive of fluorescent lamping but also of lamping utilizing light emitting diodes as the source or sources of light as well as induction lamping and the like that are relatively less wasteful of energy and which energy is converted to heat of a magnitude incapable of causing that cut-off function, that is, the inability of circuitry to function, detailed herein. Still further, reference herein to prevention of use of incandescent or similar lamping in a circuit capable of functioning with fluorescent or similar lamping refers to incandescent lamping of a useful wattage and such reference is included in both description and recitation in claims of such function.

Figure 1:
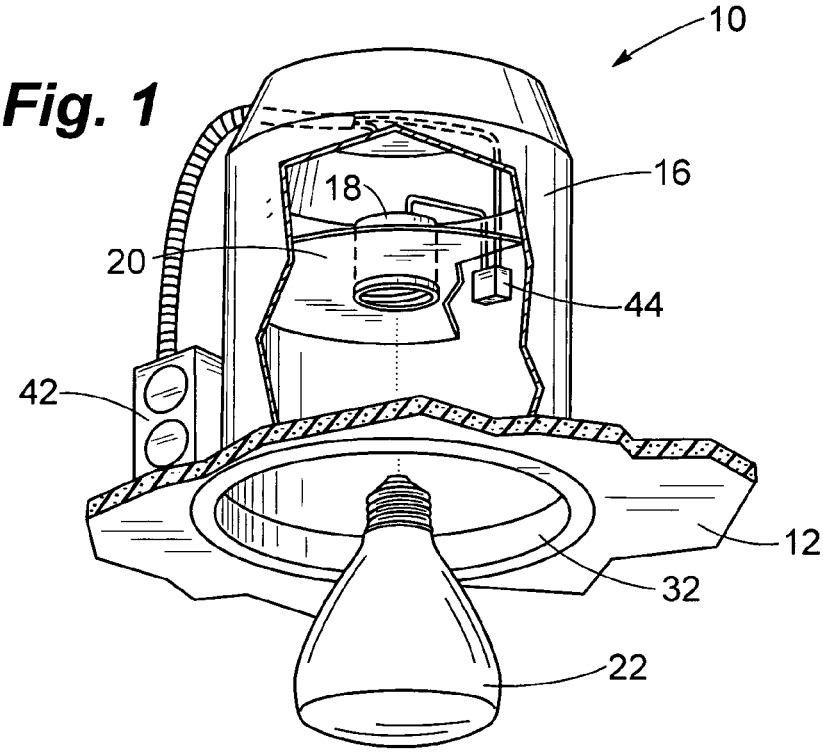
FIG. 1 is an idealized schematic of a lighting circuit operating in a recessed downlight fixture and lamped with a conventional incandescent lamp configured with a standard screw base.

Referring to the drawings and particularly to FIG. 1, an essentially conventional recessed downlighting luminaire is seen generally at 10 to be mountable such as by a conventional plaster frame (not shown) in a ceiling 12 having opening 14 formed therein. The luminaire 10 is provided with a substantially conventional lamp housing 16 within which a conventional screw base socket 18 is mounted such as by a socket plate 20. The socket 18 can be otherwise mounted such as substantially directly to upper or other portions of the housing 16. The socket 18 is seen in FIG. 1 to be capable of receiving a standard incandescent lamp 22 configured with a standard Edison-mount or screw base 24. A power source 26 conventionally provides power to the socket 18 through junction box 28.

The circuit within which the socket 18 and the power source 26 are disposed is further provided with a thermal sensor 44 capable of interrupting the supply of power to the socket 18 in the event a heat level within the lamp housing 16 is attained due to heat generated by the incandescent lamp 22 on operation of said lamp 22. The structure of the luminaire 10 thus shown and described as well as the operation thereof is conventional in the art and is similar to the lighting fixture disclosed in U.S. Pat. No. 4,324,223 which is incorporated hereinto by reference. The luminaire 10 can also be provided with a conventional trim 32.

The thermal sensor 44 can take the form of a bimetal strip such as Model No. M-13D manufactured by Portage Electric of Akron, Ohio. Alternately, the thermal sensor 44 can be chosen from a variety of thermal protection devices manufactured by Texas Instruments, Inc., suitable devices being capable of interrupting power to the lamp 22 at a sensed temperature of practical values of 80 to 85 degrees Centigrade although exigencies of a particular lamp housing and trim can result in differing power interruption temperatures.

Use according to the invention of a Texas Instruments thermal sensor or "protector" having an 85 degree Centigrade rating will, for example, permit use of a compact fluorescent lamp of 26 watts which provides a 120 watt lumen output when compared to incandescent lumen output. This thermal protector prevents use of incandescent lamping of a wattage higher than 25 watts, such lamping not being capable of producing usefully effective lighting levels in comparable applications. In recessed downlighting applications, lighting fixtures so configured typically function with either shallow or deep white baffle reflectors, recessed adjustable eyeball structures and the like as well as various trim structures.

An example of a fixture having a porcelain socket and configured with a shallow white baffle reflector, a 7B2 W trim and lamped with 40 W A15; 65 W BR30 or 75 W PAR30 lamping causes an 85 degrees Centigrade rated Texas Instruments thermal protector to interrupt circuitry within time periods effectively preventing normal use of such energy inefficient lamping. Similar results are obtained with eyeball, specular open and deep white baffle reflectors with identical energy inefficient lamping and trim with designations 7590004; TM-109R-A and 7B5 W respectively. In identical circuitry and fixture configurations, use of BPESL 15R30T (A) and Helical 26 lamping does not cause circuit interruption. The thermal protector is mounted in the tests producing the results thus described to the top of a porcelain socket having a bracket mounted to the socket as shown and described hereafter relative to FIG. 5.

The thermal sensor 44 can be located within the interior of the lamp housing 16 as is shown or can be located on an exterior surface of a lamp housing such as is shown in U.S. Pat. No. 4,685,057. Location of the thermal sensor 44 is understood to vary depending on the structure of the lamp housing 16 and even the structure of the trim 32, it being understood that a desired "kick out" temperature will be chosen according to the structure of a particular fixture so that incandescent lamping will cause the thermal sensor 44 to interrupt power to the socket 18 and therefore cannot be operated in the socket 18.

Figure 2:
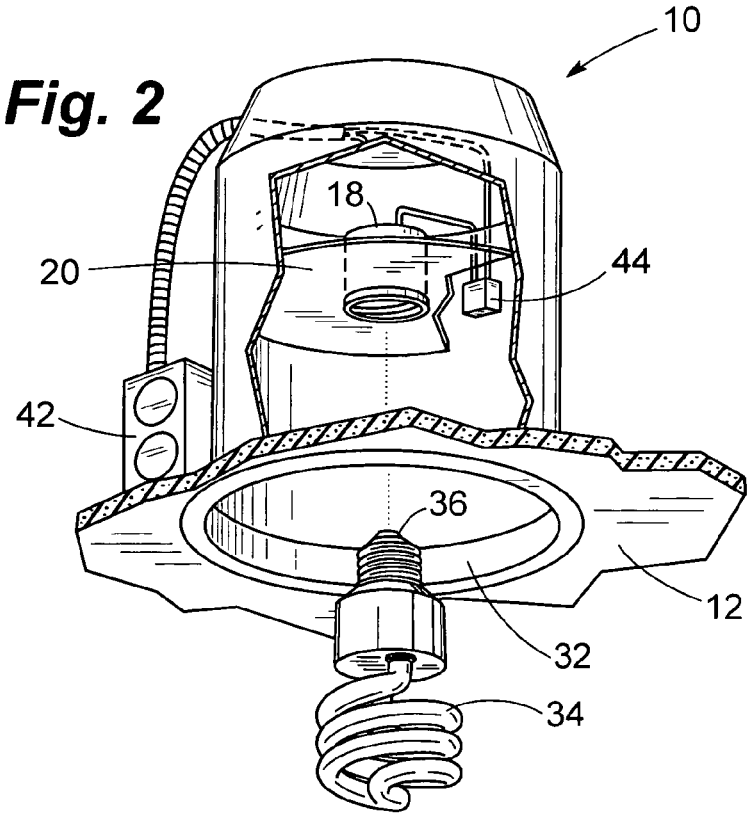
FIG. 2 is an idealized schematic of the lighting circuit and recessed downlighting fixture of FIG. 1 and lamped with a compact fluorescent lamp configured with a standard screw base.

Referring now to FIG. 2, the luminaire 10 of FIG. 1 is again shown but with a fluorescent lamp configured within a standard screw base 36 poised for connection to the socket 18. The lamp 34 can take the form of a compact fluorescent lamp of an appropriate design and appropriate dimensions permitting reception into and operation within the lamp housing 16. Heat generated by the lamp 34 is insufficient to interrupt power to the socket 18 and thus to the lamp 34. Accordingly, the fluorescent lamp 34 can be operated on connection to the socket 18 without interruption of power to the lamp 34.

The method of using the luminaire structure shown in FIGS. 1 and 2 including the socket 18 and thermal sensor 44 assures compliance with energy efficiency regulations such as Title 24 of the State of California without the necessity for using a socket (not shown) only capable of reception of energy efficient lamping such as fluorescent lamping and the like having pin bases or prong bases and the like. The method of the invention permits use of compact fluorescent lamping configured with standard screw bases as are readily purchased by consumers.

Figure 3:
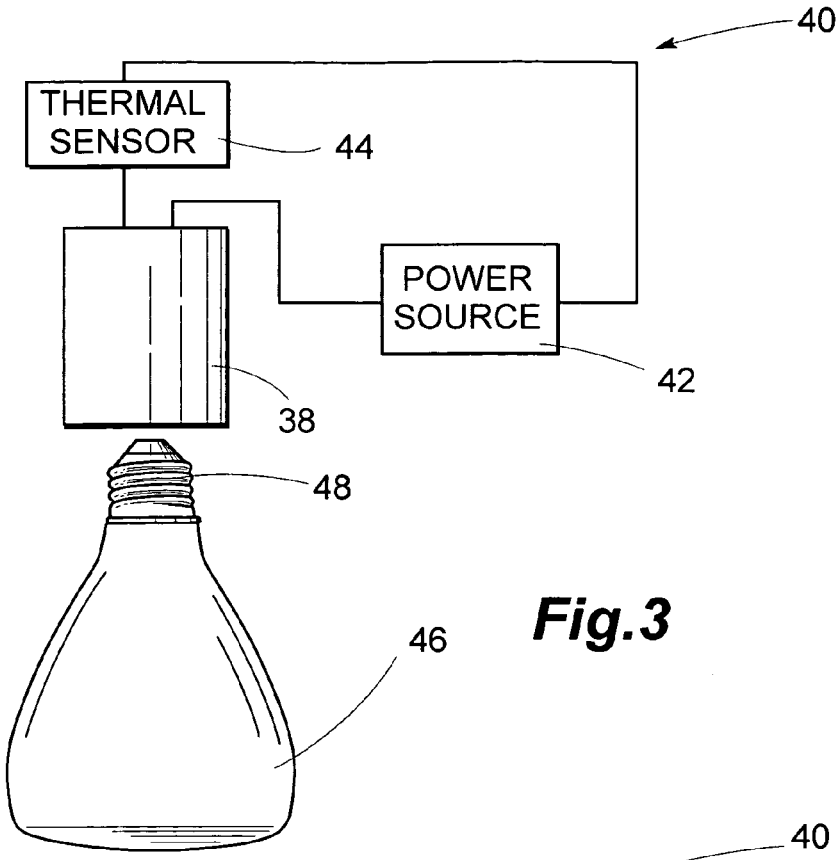
FIG. 3 is an idealized schematic of a lighting circuit having a standard screw base socket and lamped with a conventional incandescent lamp configured with a standard screw base.

Referring now to FIG. 3, a conventional screw base socket 38 is seen to be disposed in a lighting circuit seen generally at 40. The circuit 40 includes a power source 42 and the thermal sensor 44 seen also in FIGS. 1 and 2 and which is preferably integrally configured within the interior of the socket 38 in any manner including any conventional manner such as the structures disclosed in U.S. Pat. Nos. 2,458,724; 4,131,868 and 4,396,898 inter alia, the disclosures of these patents being incorporated hereinto by reference. The thermal sensor 44 is set to interrupt power to the circuit 48 when temperatures experienced by the sensor 44 reach a predetermined level. That level is set to that temperature caused by an incandescent lamp 46 sufficient for providing effective illumination and which is fitted through screw base 48 formed integrally within the lamp 46 in a conventional manner. Accordingly, use of the circuit 40 within the incandescent lamp 46 is prevented by the presence of the thermal sensor 44 thus assuring the circuit 40 cannot be used with energy inefficient lamping including incandescent lamping.

Figure 4:
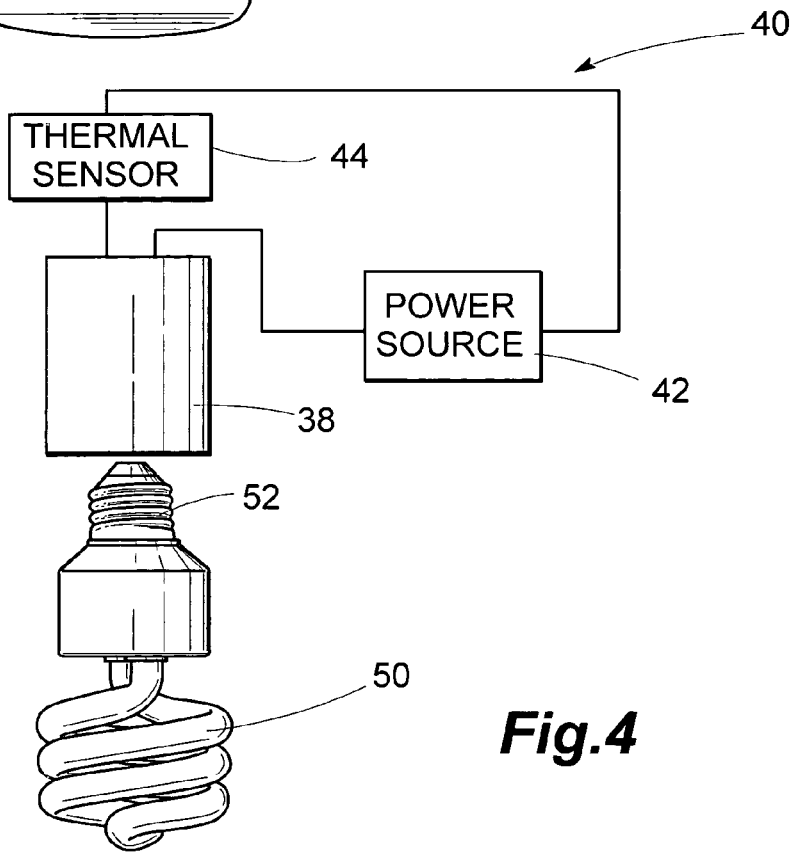
FIG. 4 is an idealized schematic of the lighting circuit of FIG. 3 having a standard screw base socket and lamped with a conventional fluorescent lamp configured with a standard screw base; and, FIG. 5 is a perspective view of a screw base socket having a bracket mounted to the socket, lamping representative of either energy inefficient lamping or energy efficient lamping being shown in phantom.

Referring now to FIG. 4, the circuit 40 is again seen but is used with a fluorescent lamp 50 having an integral screw base 52 which is received into the socket 38, the lamp 50 conveniently taking the form of readily available compact fluorescent lamping. Such fluorescent lamping does not generate sufficient heat to trigger operation of the thermal sensor 44, thereby permitting use of the lighting circuit 40 only with energy efficient lamping such as fluorescent lamping or the like.

Figure 5:
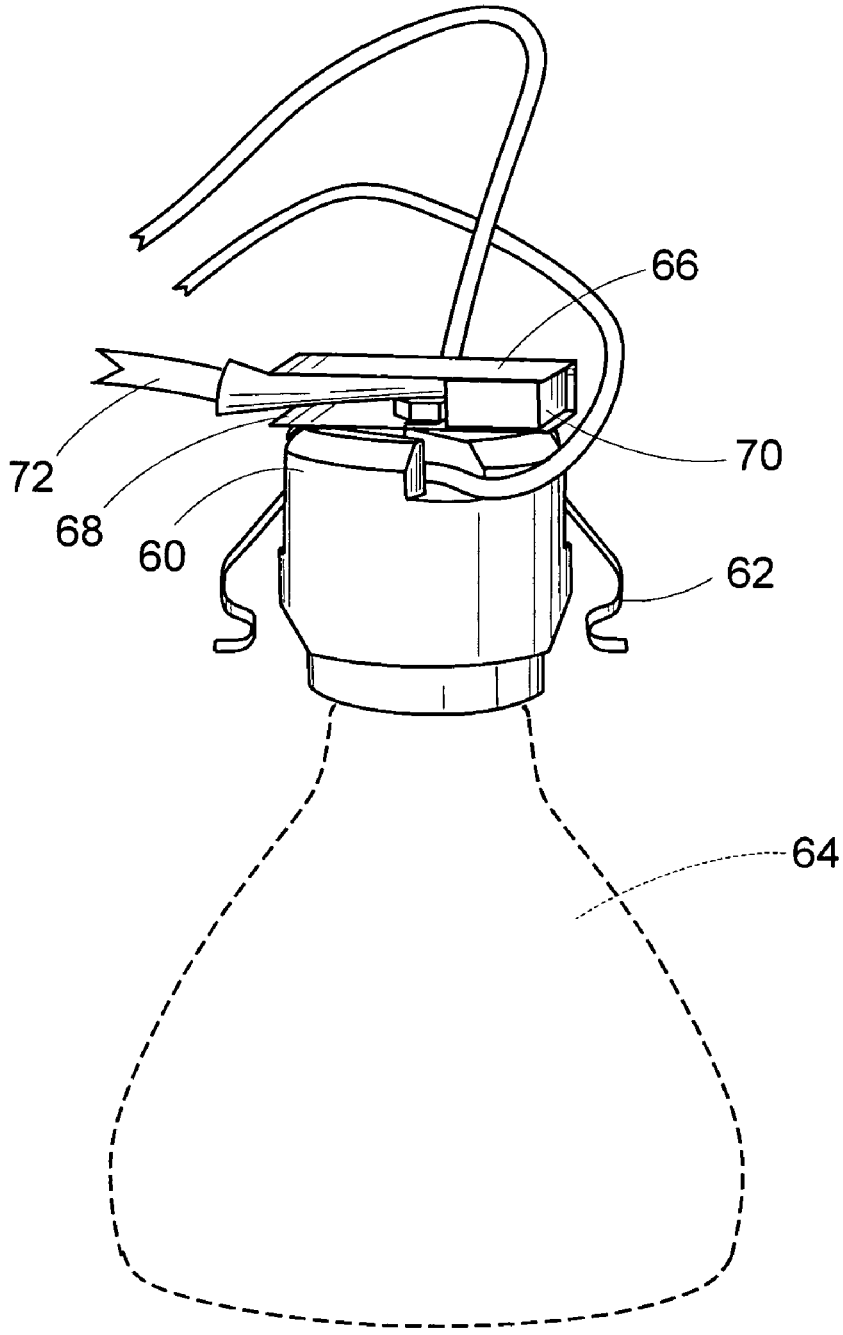

In FIG. 5, a screw base porcelain socket 60 of conventional configuration is seen to be provided with a conventional mounting clip 62 fixed to the top of the socket 60. The socket 60 receives lamping having a screw base, such lamping being represented in phantom by the numeral 64 to be both energy efficient or energy inefficient lamping. A U-shaped bracket 66 is connected to the clip 62 such as by riveting one leg 68 of the bracket 66 to the clip 62. The leg 68 can be received between the clip 62 and the top of the socket 60. The bracket 66 can be configured to have a spring-like capability such that a thermal sensor 70, such as a Texas Instruments thermal protector, can be received within the bracket 66 and held therein. The sensor 70 connects to a source of power (not shown) by leads 72. The socket 60 is conventionally mounted by a lamp housing (not shown) in a recessed downlighting fixture (not shown). The lamping 64 when chosen to be an energy inefficient lamp will cause interruption of a circuit having the socket 60 therein while choice of an energy efficient lamp will permit function of such a circuit.

The socket arrangement thus shown in FIG. 5 provides a useful embodiment of apparatus according to the invention and is that structure with which performance data provided herein was generated. It is to be understood that the structure shown in FIG. 5 is for illustration, the invention contemplating other sensor arrangements including the use of multiple sensors including arrays of sensors wherein functioning of one or more sensors is capable of causing the results herein detailed.

The methods of the invention for assuring compliance with mandated energy efficiency standards for lighting applications accordingly involve configuration of lighting circuitry including screw base sockets only capable of operation with energy efficient lamping such as fluorescent lamping and the like due to the provision in the circuitry of at least one thermal sensing device capable of interrupting power to the lighting circuitry in the event an attempt is made to fit energy inefficient lamping such as incandescent lamping or the like into a screw base socket contained in the circuitry. The methodology of the invention can also be practiced in the absence of mandated energy efficiency standards with resulting energy saving.

It is to be understood that the invention is described herein relative to preferred embodiments, this description not being limiting of the scope of the invention which is to be defined by the scope of the appended claims.

What is claimed is:

1. A method for assuring compliance with mandated energy efficiency standards requiring use of energy efficient lamping including fluorescent lamping configured with a screw base in a lighting circuit configured with a screw base socket and having a power source in the circuit and a thermal sensing device in the circuit capable of discontinuing power to the socket on sensing of a temperature above a predetermined value comprising the step of setting the thermal sensing device to a value permitting use of fluorescent lamping in the circuit yet not permitting use of incandescent lamping adequate to produce illumination in the circuit.

2. The method of claim 1 wherein the temperature value is in a range of 80 to 85 degrees Centigrade.

3. A method for preventing the use of energy inefficient electrical loads in a circuit having a socket capable of being fitted with said energy efficient electrical loads as well as energy inefficient electrical loads, and a source of power, the circuit being only useable with energy efficient electrical loads capable of being fitted into said socket for operation by the source of power, comprising the step of:

disposing a thermal sensing device in the circuit;

setting the thermal sensing device to a thermal value sufficient to interrupt power to the circuit on generation of heat levels characteristic of energy inefficient electrical loads thereby to cause the energy inefficient electrical load to be incapable of operation in the circuit; and, connecting the energy efficient electrical load to the socket, the energy efficient electrical load being capable of operation in the circuit.

4. The method of claim 3 wherein the energy inefficient electrical load comprises incandescent lamping and wherein the energy efficient electrical load comprises fluorescent lamping.

5. The method of claim 4 wherein the socket comprises a screw base socket and wherein the lamping is configured with screw base structures capable of reception into the socket.

6. The method of claim 5 wherein the energy efficient lamping comprises a compact fluorescent lamp.

7. The method of claim 4 wherein the incandescent lamping is configured to have a wattage effective to produce adequate illumination for an application for which the circuit is used.

8. The method of claim 4 wherein the thermal sensing device is disposed in spaced relation to the socket.

9. The method of claim 4 wherein the thermal sensing device is configured integrally with the socket.

10. The method of claim 4 wherein the circuit is disposed in a recessed downlighting fixture.

* * * * *